United States Patent [19]

Granlund

[11] 4,334,562

[45] Jun. 15, 1982

[54] APPARATUS FOR CUTTING AND SPLITTING LOGS

[75] Inventor: Per Granlund, Moelv, Norway

[73] Assignee: A/S Moelven Brug, Moelv, Norway

[21] Appl. No.: 215,368

[22] Filed: Dec. 11, 1980

[30] Foreign Application Priority Data

Jan. 25, 1980 [NO] Norway ..... 800177

[51] Int. Cl.[3] ..... B27L 7/00

[52] U.S. Cl. ..... 144/193 A; 144/3 K

[58] Field of Search ..... 144/3 K, 193 R, 193 A

[56] References Cited

U.S. PATENT DOCUMENTS 4,081,008 3/1978 Dilling ..... 144/3 K 4,102,373 7/1978 Winiasz ..... 144/3 K 4,273,171 6/1981 Spaulding, Sr. ..... 144/3 K

*Primary Examiner*—W. D. Bray

*Attorney, Agent, or Firm*—Holman & Stern

[57] ABSTRACT

Apparatus for cutting and splitting logs, preferably into firewood wherein both the cutting and the splitting of the log are performed in the same operation, the tree trunk is placed on a foundation, and guided comprising a foundation with post members upstanding therefrom and two vertically-disposed knives in a T-shaped configuration operating vertically between said posts, the lateral edges of at least one knife member being guided in a guide member. The knives are driven downwardly toward the log so that the tree is cut crosswise and split longitudinally in the same working operation.

3 Claims, 2 Drawing Figures

APPARATUS FOR CUTTING AND SPLITTING LOGS

BRIEF SUMMARY OF THE INVENTION

The present invention relates to an apparatus for cutting and splitting logs, preferably for firewood.

Owing to the uncertain situation on the energy front, alternative methods of heating homes have recently come under discussion, particularly with a view to the traditional method of heating with wood, using second-grade products from our forests.

However, the provision of large enough quantities of wood for this purpose is a problem, because no rational system for handling and processing the timber has heretofore been developed. It is impractical for the individual consumer to receive wood from the forests in full lengths. He would have to engage a crew with a cross-cut saw to cut the tree trunks, and the logs thus produced would then have to be split.

As a result, even though the cost of the timber itself is relatively low, the final product—the firewood ready to be fed into the stove—is as a rule unreasonably expensive. The natural solution, then, is to arrive at a system whereby the wood is delivered to the consumer in a finished, cut and split state. Some rather large, stationary cutting and splitting installations do exist, where, for example, the logs are cut with a conventional circular saw and the actual splitting is performed by splitting means (screw systems, for instance) which split the logs by mechanical force. Cutting and splitting systems are also found in which the logs are first cut into lengths by knives pressed into contact against the log from at least two sides thereof while at the same time the side branches are also stripped off. The logs thus produced are subsequently split in a log-splitting machine, wherein, for example, one end of the log is placed on a foundation and the log-splitting head is driven into contact with the other end of the log by means of a hydraulic cylinder to split the log.

The above cutting/splitting operations require two operators if the cutting machine and the splitting machine are to be utilized fully. Such systems are thus relatively large-scale operations and expensive to use.

To reduce handling costs, it would be more advantageous economically to decentralize the cutting and splitting operation, that is, to perform the operation out in the forest or perhaps even on-site on the land of the individual farmer or owner of the forest.

Thus, there appears to be a need for a simple tool which landowners, in combination with their farming operations, could use to produce finished firewood for personal use as well as for sale. To be most practical, such equipment should be easily transportable and should be able to be used together with a conventional tractor, the tractor being used both to move the equipment to the desired location and the power outlet or hydraulic outlet of the tractor providing the power for operating the cutting and splitting equipment.

The known installation for cutting and splitting wood thus require two work operations. The object of the present system is to enable one to cut and split the logs in the same operation. The advantages of this solution are that much time is saved since both operations are performed simultaneously, and full utilization of the machine can be obtained using only one operator.

The above advantages are obtained with the apparatus of this invention whereby the log is placed on a foundation and guided on a foundation to abut against an optional stop means provided in the longitudinal direction, and that two vertically disposed knives are driven down toward the log such that the tree log is cut through crosswise and split longitudinally in the same work operation.

In this "guillotine" operation the log is split only one time, but this will in practice be sufficient. In addition, there are only two movable parts in accordance with the invention, namely the piston rod/piston and the knife, which facilitates reliable operation.

The present invention also relates to an apparatus for cutting and splitting logs, which is characterized in that it comprises a foundation for the logs and knives for cutting the log transversely and splitting the log longitudinally, wherein the knives are arranged in a T-configuration such that they constitute one knife for the combined cutting-splitting operation, said apparatus also including guide members for at least the lateral edges of one knife member.

With the cutting-splitting apparatus defined above, logs of up to 30 cm diameter have been processed. This will in practice be sufficient for ordinary forest operations, but there is no reason that the dimensions of the construction could not be increased so that larger-diameter logs could be handled, this being merely a question of ensuring the sufficient power is available for driving the larger equipment.

BRIEF DESCRIPTION OF THE DRAWINGS

The present invention will be described in greater detail in the following discussion of embodiment examples and with reference to the accompanying drawings, where.

Figure 1:
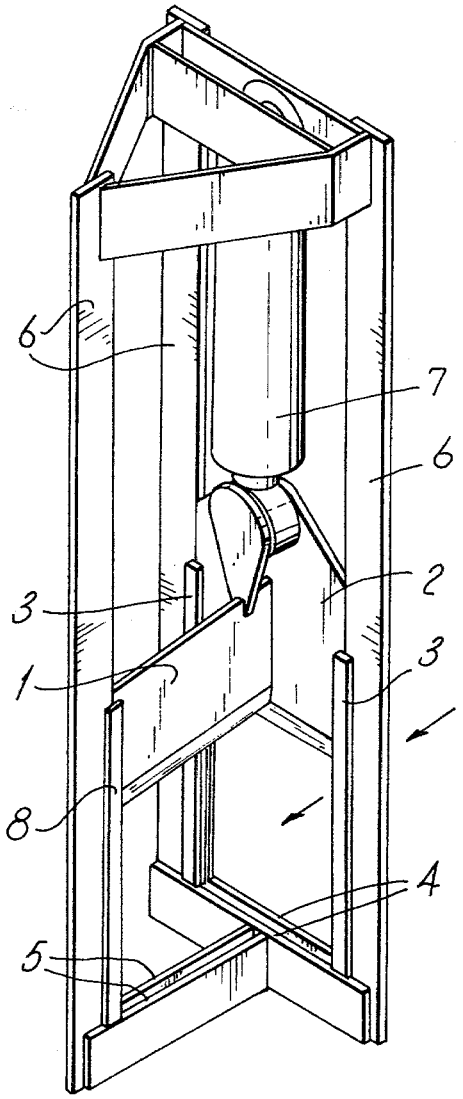
FIG. 1 shows the cutting/splitting apparatus of this invention in perspective view.

The cutting/splitting apparatus consists of a knife 1 which serves as a cleaving axe and a knife 2 which serves as a cutting axe. These two knife members are assembled into a T-shaped knife which when supplied with power via a cylinder 7 from a tractor will be driven down through a log toward a foundation 4, 5 such that the log will be both cut and split. The knife 1, 2 is activated by the double-acting hydraulic cylinder 7, which is connected to a hydraulic unit having a maneouvering valve for controlling the back-and-forth movement (not illustrated herein). The knife 1, 2 can also be activated in some other manner, for example, by mechanical transmission.

The cylinder 7 is dimensioned such that, with the pressure available, it will exert sufficiently great force that logs of a diameter which can be inserted between the guides 3 will be cut and split.

The vertical guides 3, the foundation 4, 5 and the upright posts 6 together form a frame which also is the support for the double-acting hydraulic cylinder 7.

In the embodiment illustrated in FIG. 1, three sets of vertical guide members 3, 8 are placed slightly in front of and outside the posts 6, such that the lateral edges of the knife 1, 2 are in contact with the posts 6 and lie between the guide members 3, 8. In addition, the foundation members 4, 5 are also placed outside the posts such that the edge of the knife 1, 2 passes between the foundations, thus ensuring that the log will be cut and split completely through.

Figure 2:
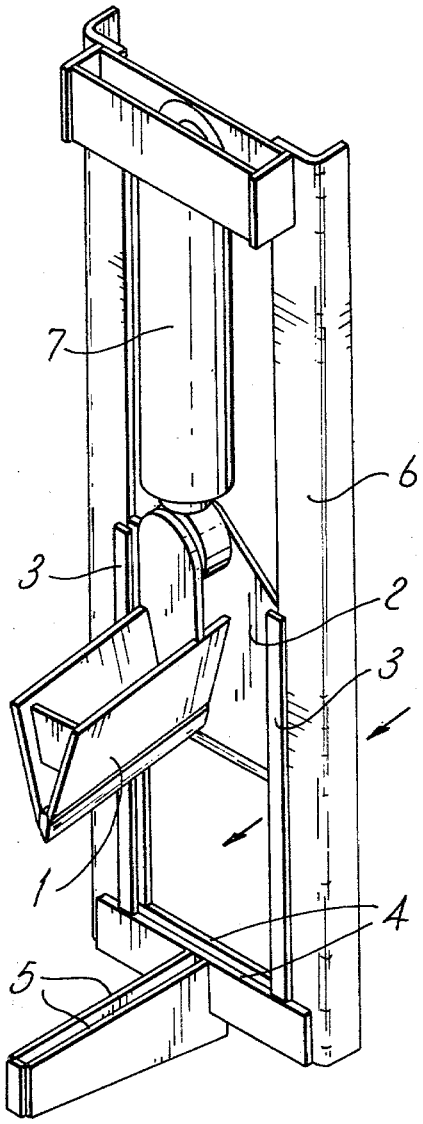
FIG. 2 shows a modified embodiment of the cutting/-splitting apparatus of FIG. 1.

FIG. 2 shows a modified embodiment of the cutting/-splitting apparatus wherein one set of vertical guide members has been omitted such that one blade 1 (the cleaving blade) of the knife 1, 2 has no guide member. In this embodiment, the splitting axe 1 is also shaped somewhat differently in order to obtain greater stability.

In FIG. 1, a fixed stop means for determining the length of the log to be cut is provided in the form of the one post 6, such that the log will abut against said one post 6 when it is inserted between the guide members 3. A stop means of some sort must also be provided in connection with the embodiment shown in FIG. 2, where said post 6 is not present (such a stop means is not illustrated in the drawing). With the embodiment of FIG. 2, one obtains greater flexibility as to the length of the cut logs, as one then select the length which is most appropriate in each case.

In both embodiments, the cross-cutting axe portion 2 of the knife is displaced downwardly toward the foundation 4 in relation to the splitting axe portion 1. This is done so that the log will be securely retained by the cutting axe when the splitting operation commences.

The apparatus, as mentioned previously, is hydraulically operated. Alternately, however, the power medium could be an electric or diesel motor with a pumping unit and the necessary regulatory equipment. It is most practical, however, to use a conventional tractor. Tractors are available on the market which have sufficient oil pressure and sufficient volume of oil per minute to permit the "guillotine" to be operated directly from the oil outlet of the tractor at sufficient working speed. For tractors which do not have these characteristics (and this applies to most tractors in use today), it will be necessary to connect an oil pumping unit with a tank (and of course the necessary regulating equipment) to the power outlet for the tractor.

It is naturally also possible to expand the system with conveyors to bring the logs to the guillotine and a conveyor to transport the finished, cut and split wood to a box, sack, tractor trailer or the like.

It is also possible to arrange the knives 1, 2 separately, i.e., not connected but in a T-shaped orientation one to the other.

In that case, the knives can have separate drive means and an extra guide member for the splitting axe could be provided on the cutting axe such that the two operations could be performed independently of one another, if desired.

Having described my invention, I claim:

1. A combined log cutting and splitting apparatus for cutting and splitting firewood comprising a T-shaped foundation base member, a plurality of upstanding support posts attached to and extending from said base member, bracing members attached to the tops of said posts to interconnect them to form a rigid frame, a hydraulic piston-cylinder power drive member supported on said rigid frame adjacent to and depending from the top thereof so that said cylinder is disposed substantially between said posts, a cross-cutting knife attached to the lower end of said piston-cylinder member to be reciprocated substantially vertically thereby to cross-cut a log placed on said base member in the area between said posts, a splitting knife attached to the lower end of said piston-cylinder member, and to said cross-cutting knife to form a substantially T-shaped configuration therewith and to split the cut-off section of the log substantially simultaneously with the cross-cutting, said cross-cutting knife being downwardly displaced with respect to said splitting knife so that cross-cutting begins before splitting and said cross-cutting knife retains said log in position during splitting, and guide means on at least one of said posts engaging the adjacent side edge of said cross-cutting knife.

2. The apparatus as claimed in claim 1 wherein three upstanding support posts are provided extending substantially parallel with respect to each other from the ends of said T-shaped base.

3. The apparatus as claimed in claim 2 wherein guide means are provided on each said post in sliding engagement with the side edges of said cutting and splitting knives, said T-shaped configuration of said knives reciprocating in the vertical planes of said T-shaped base member.

* * * * *